US010907839B2

(12) United States Patent
Wu

(10) Patent No.: US 10,907,839 B2
(45) Date of Patent: Feb. 2, 2021

(54) METHOD AND DEVICE FOR CONTROLLING RANGE HOOD, AND STORAGE MEDIUM

(71) Applicant: BEIJING XIAOMI MOBILE SOFTWARE CO., LTD., Beijing (CN)

(72) Inventor: Ke Wu, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 109 days.

(21) Appl. No.: 16/113,596

(22) Filed: Aug. 27, 2018

(65) Prior Publication Data

US 2019/0162420 A1 May 30, 2019

(30) Foreign Application Priority Data

Nov. 24, 2017 (CN) ..... 2017 1 1188222

(51) Int. Cl.
*F24C 15/20* (2006.01)

(52) U.S. Cl.
CPC ..... *F24C 15/2021* (2013.01); *F24C 15/2042* (2013.01)

(58) Field of Classification Search
CPC ... F24C 15/2021; F24C 15/2042; F24C 15/20
USPC ..... 126/299 D
See application file for complete search history.

(56) References Cited

U.S. PATENT DOCUMENTS

| | | | | |
|---|---|---|---|---|
| 4,963,375 | A | 10/1990 | Sato et al. | |
| 6,444,958 | B1 * | 9/2002 | Campbell | F24C 15/101 126/21 R |
| 2015/0226439 | A1 * | 8/2015 | Mikulec | F24C 15/2021 99/337 |

FOREIGN PATENT DOCUMENTS

| | | | |
|---|---|---|---|
| CN | 103230167 | A | 8/2013 |
| CN | 105326408 | A | 2/2016 |
| CN | 105652680 | A * | 6/2016 |
| CN | 105652680 | A | 6/2016 |
| CN | 205608417 | U | 9/2016 |
| CN | 106213971 | A | 12/2016 |
| CN | 106482185 | A | 3/2017 |
| CN | 106873413 | A | 6/2017 |
| CN | 107101235 | A | 8/2017 |
| EP | 2 420 471 | A2 | 2/2012 |
| JP | 5-83603 | U | 11/1993 |
| JP | 2004-31089 | A | 1/2004 |
| JP | 2017-40430 | A | 2/2017 |
| KR | 10-2017-0006090 | A | 1/2017 |

OTHER PUBLICATIONS

Extended European Search Report dated Apr. 16, 2019 in Patent Application No. 18207043.3, 7 pages.

(Continued)

*Primary Examiner* — Steven B McAllister
*Assistant Examiner* — Aaron H Heyamoto
(74) *Attorney, Agent, or Firm* — Oblon, McClelland, Maier & Neustadt, L.L.P.

(57) ABSTRACT

Aspects of the disclosure provide a method for controlling a range hood. The method can include acquiring a cooking parameter during cooking of food that indicates a state of the food, determining a target operating power of the range hood according to the cooking parameter, and controlling the range hood to operate according to the target operating.

17 Claims, 3 Drawing Sheets

(56) References Cited

OTHER PUBLICATIONS

Combined Office Action and Search Report dated May 17, 2019 in Chinese Patent Application No. 201711188222.0, 16 pages (with English translation).
International Search Report and Written Opinion dated Aug. 13, 2018 in corresponding PCT/CN2018/082556 filed on Apr. 10, 2018, with English translation and English translation of category of cited docuemtns, 12 pages.
Japanese Office Action dated Jan. 31, 2020 in Patent Application No. 2018-526783 (with English translation), 8 pages.
Korean Office Action dated Mar. 9, 2020 in Patent Application No. 10-2019-7011558 (with English translation), 17 pages.

* cited by examiner

METHOD AND DEVICE FOR CONTROLLING RANGE HOOD, AND STORAGE MEDIUM

CROSS-REFERENCE TO RELATED APPLICATIONS

This application is based on and claims priority to Chinese Patent Application No. 201711188222.0, filed with the State Intellectual Property Office of P. R. China on Nov. 24, 2017, which is incorporated herein by reference in its entirety.

TECHNICAL FIELD

The present disclosure relates to the field of household appliances, and more particularly, to a method or a device for controlling a range hood.

BACKGROUND

At present, range hoods are usually arranged in the kitchen, such that cooking smoke in the kitchen can be discharged in time. The range hoods often have different operating power (e.g., input power or output power of a motor driving a fan). For example, when the range hood is operating, the greater the operating power is, the greater the wind power of the motor is, such that more cooking smoke can be discharged; the smaller the operating power is, the smaller the wind power of the motor is, such that a small amount of cooking smoke can be discharged.

In the related art, after the range hood is powered on, the user may adjust the operating power of the range hood according to actual conditions during cooking. For example, when the user finds that there is too much cooking smoke during the cooking, the user may manually adjust the operating mode of the range hood, such that the range hood can operate at a higher operating power. When the user finds that there is less cooking smoke during the cooking, the user may manually adjust the operating mode of the range hood, such that the range hood can operate at a lower operating power.

SUMMARY

Aspects of the disclosure provide a method for controlling a range hood. The method can include acquiring a cooking parameter during cooking of food that indicates a state of the food, determining a target operating power of the range hood according to the cooking parameter, and controlling the range hood to operate according to the target operating power.

In an embodiment, the acquiring the cooking parameter during the cooking of the food includes at least one of receiving weight data from a cooking stove or a cooking pot, and determining a weight of the food according to the weight data, receiving a picture of the food from a camera, and determining a color of the food according to pixel values of the picture, or receiving a smoke density from a smoke density sensor.

In an embodiment, the determining the target operating power of the range hood according to the cooking parameter includes setting a first preset power as the target operating power of the range hood when a weight of the food is greater than a preset weight, and setting a second preset power as the target operating power of the range hood when the weight of the food is less than the preset weight.

In an embodiment, the determining the target operating power of the range hood according to the cooking parameter includes setting a third preset power as the target operating power of the range hood when a current color of the food is not within a preset color range, and setting a fourth preset power as the target operating power of the range hood when the current color of the food is within the preset color range. In one example, after setting the third preset power as the target operating power of the range hood, an alarm message to raise an alarm for the cooking is generated, and/or supplying power or gas for cooking the food is stopped.

In an embodiment, the determining the target operating power of the range hood according to the cooking parameter includes setting a fifth preset power as the target operating power of the range hood when a smoke density is greater than a preset smoke density, and setting a sixth preset power as the target operating power of the range hood when the smoke density is less than the preset smoke density. In one embodiment, after setting the fifth preset power as the target operating power of the range hood, an alarm message to raise an alarm for the cooking is generated, and/or supplying power or gas for cooking the food is stopped.

Aspects of the disclosure provide a device for controlling a range hood. The device can include a processor; and a memory configured to store instructions executable by the processor. The processor is configured to acquire a cooking parameter during cooking of food, the cooking parameter indicating a state of the food during the cooking, determine a target operating power of the range hood according to the cooking parameter, and control the range hood to operate according to the target operating power.

Aspects of the disclosure further provide a computer-readable non-transitory storage medium storing instructions. The instructions, when executed by a processor, cause the processor to perform the method for controlling the range hood.

BRIEF DESCRIPTION OF THE DRAWINGS

The accompanying drawings, which are incorporated in and constitute a part of this specification, illustrate aspects consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of apparatuses and methods consistent with aspects related to the present disclosure as recited in the appended claims.

Before embodiments of the present disclosure are described in detail, application scenarios of embodiments of the present disclosure will be introduced first.

Since cooking food will generate cooking smoke during cooking, if the cooking smoke is not discharged in time, hygiene of the kitchen may be affected. Therefore, the kitchen is usually equipped with a range hood, such that the cooking smoke generated during the cooking can be timely discharged. The method for controlling a range hood provided in embodiments of the present disclosure may be applied to a scene that cooking smoke generated during cooking is timely discharged.

Since the user needs to manually adjust the operating mode of the range hood in the related art, to achieve control of the range hood, efficiency of controlling the range hood is reduced, and user experience of the range hood is affected. Therefore, embodiments of the present disclosure provide a method for controlling a range hood. The method includes determining a target operating power of the range hood according to cooking parameters of food during cooking, and controlling the range hood to operate according to the target operating power. Since the cooking parameters are configured to describe a state of the food during the cooking, the method for controlling a range hood provided by embodiments of the present disclosure can automatically adjust the operating power of the range hood according to the state of the food during cooking and avoid adjusting the operating power of the range hood manually, thereby improving efficiency of controlling the range hood, and improving user experience of the range hood.

Figure 1:
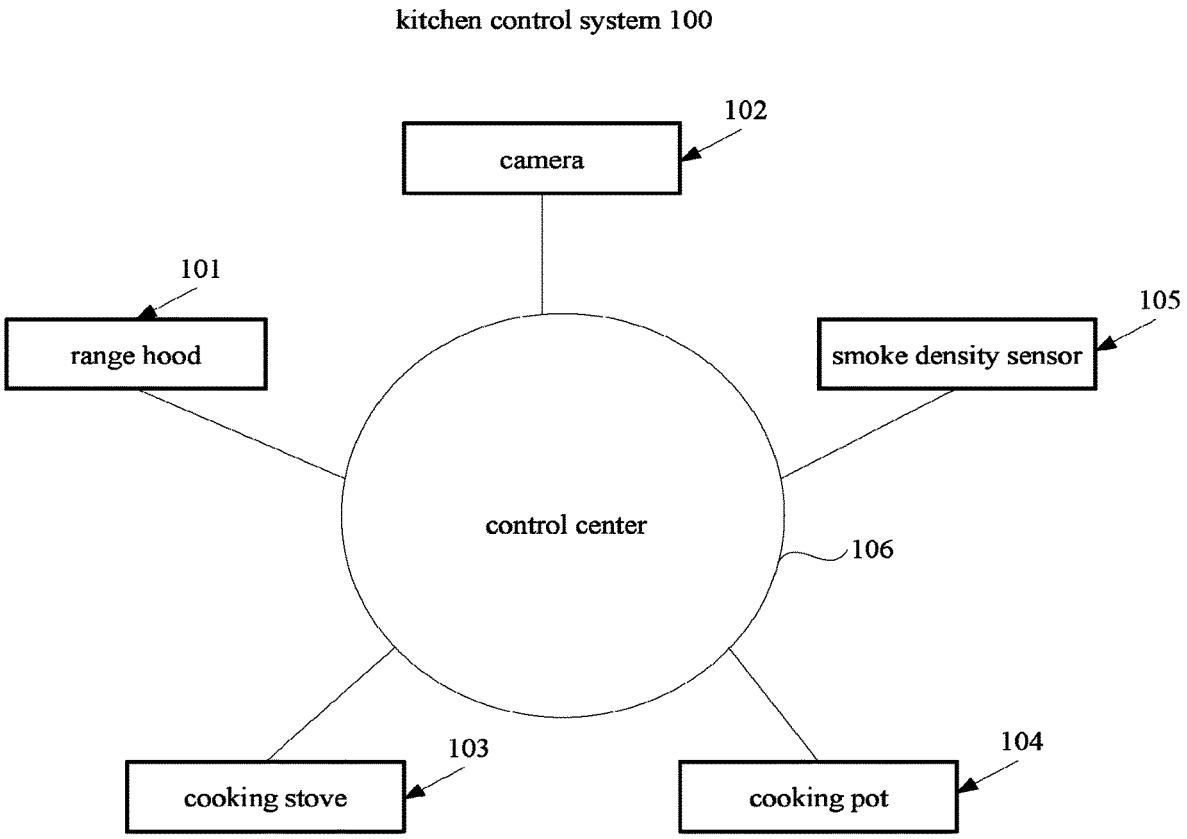
FIG. 1 is a schematic diagram of a kitchen control system according to an embodiment of the present disclosure.

Since the method for controlling a range hood provided by embodiments of the present disclosure may be applied to implement automatic control of the range hood, embodiments of the present disclosure further provide a kitchen control system. As illustrated in FIG. 1, the kitchen control system 100 includes a range hood 101, a camera 102, a cooking stove 103 for cooking food, a cooking pot 104 for cooking food, a smoke density sensor 105, and a control center 106.

The range hood 101, the camera 102, the cooking stove 103 for cooking food, the cooking pot 104 for cooking food and the smoke density sensor 105 may communicate with the control center 106 in a wired or wireless manner.

The range hood 101 is configured to operate according to a control instruction sent by the control center 106, to discharge cooking smoke generated during the cooking. The camera 102 is configured to capture a picture of the food during the cooking, and report the captured picture to the control center 106. In addition to cooking the food, the cooking stove 103 or the cooking pot 104 is further configured to determine weight data by a weight scale installed thereon, and report the weight data to the control center 106. The smoke density sensor 105 is configured to determine a current smoke density, and report the smoke density to the control center 106. The control center 106 is configured to determine operating power of the range hood 101 according to the picture reported by the camera 102, the weight data reported by the cooking stove 103 or the cooking pot 104 and the smoke density reported by the smoke density sensor 105, and send the control instruction to the range hood 101, so as to enable the range hood 101 to operate according to the determined operating power.

In at least one embodiment, the range hood 101, the camera 102, the cooking stove 103 for cooking food, the cooking pot 104 for cooking food and the smoke density sensor 105 may also communicate with the range hood 101 in a wired or wireless manner. In this case, the range hood 101 is equivalent to the control center 106 in FIG. 1, i.e., the range hood 101 determines its own operating power according to the picture reported by the camera 102, the weight data reported by the cooking stove 103 or the cooking pot 104 and the smoke density reported by the smoke density sensor 105, and operates according to the determined operating power.

In addition, the camera 102 and the smoke density sensor 105 may be a camera and a smoke density sensor separately arranged in the kitchen, or may be a camera and a smoke density sensor integrated in the range hood 101, which is not limited in embodiments of the present disclosure.

The control center 106 may be a terminal such as a mobile phone, a tablet computer, or a computer, or may be a server communicating with other components of the system 100 via a network. In one example, the control center 106 is integrated into the range hood 101, and is a component of the range hood 101.

In the following, the method for controlling a range hood provided by embodiments of the present disclosure is described in detail.

Figure 2:
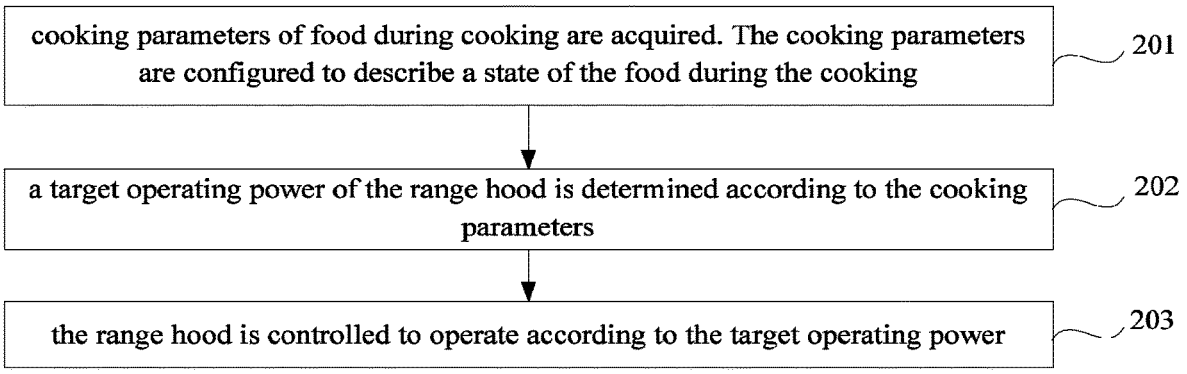
FIG. 2 is a flow chart of a method for controlling a range hood according to an embodiment of the present disclosure.

FIG. 2 is a flow chart of a method for controlling a range hood according to an embodiment of the present disclosure. As illustrated in FIG. 2, the method may include the followings.

At block 201, cooking parameters of food during cooking are acquired. The cooking parameters are configured to describe a state of the food during the cooking.

At block 202, a target operating power of the range hood is determined according to the cooking parameters.

At block 203, the range hood is controlled to operate according to the target operating power.

In embodiments of the present disclosure, the target operating power of the range hood is determined according to the cooking parameters of the food during cooking, such that the range hood can be controlled to operate according to the target operating power. Since the cooking parameters are configured to describe the state of the food during the cooking, the method for controlling a range hood provided by embodiments of the present disclosure can automatically adjust the operating power of the range hood according to the state of the food during the cooking and avoid adjusting the operating power of the range hood manually, thereby improving efficiency of controlling the range hood, and improving user experience of the range hood.

In at least one embodiment, the cooking parameters include at least one of a weight of the food, a current color of the food and a smoke density.

Acquiring the cooking parameters of the food during cooking includes at least one of: receiving weight data reported by a cooking stove or a cooking pot for cooking the food, and determining the weight of the food according to the weight data; acquiring a picture of the food captured by a camera, and determining the color of the food according to pixel values of pixel points in the picture; and receiving the smoke density reported by a smoke density sensor.

In at least one embodiment, the cooking parameters include the weight of the food.

Determining the target operating power of the range hood according to the cooking parameters includes: setting a first preset power as the target operating power of the range hood when the weight of the food is greater than a preset weight, and setting a second preset power as the target operating power of the range hood when the weight of the food is less than or equal to the preset weight. The first preset power is greater than the second preset power.

In at least one embodiment, the cooking parameters include the current color of the food.

Determining the target operating power of the range hood according to the cooking parameters includes: setting a third preset power as the target operating power of the range hood when the current color of the food (e.g., an averaged pixel values) is not within a preset color range, in which the preset color range is a standard color range of the food (e.g., a range of pixel values), and setting a fourth preset power as the target operating power of the range hood when the current color of the food is within the preset color range. The third preset power is greater than the fourth preset power.

In at least one embodiment, after the third preset power is set as the target operating power of the range hood, the method further includes: generating an alarm message to raise an alarm for cooking, and stopping supplying power or gas for cooking the food.

In at least one embodiment, the cooking parameters include the smoke density.

Determining the target operating power of the range hood according to the cooking parameters includes: setting a fifth preset power as the target operating power of the range hood when the smoke density is greater than a preset smoke density, and setting a sixth preset power as the target operating power of the range hood when the smoke density is less than or equal to the preset smoke density. The fifth preset power is greater than the sixth preset power.

In at least one embodiment, after the fifth preset power is set as the target operating power of the range hood, the method further includes: generating an alarm message to raise an alarm for cooking, and stopping supplying power or gas for cooking the food.

All of the foregoing technical solutions may be arbitrarily combined to form alternative embodiments of the present disclosure, which are not described in detail in embodiments of the present disclosure.

It can be seen from the kitchen control system illustrated in FIG. 1 that, the method for controlling a range hood illustrated in FIG. 2 may be performed by a control center, and may also be performed by the range hood itself, which is not limited in embodiments of the present disclosure. In particular, the following embodiments will be described in detail by the control center performing the method for controlling a range hood illustrated in FIG. 2.

Figure 3:
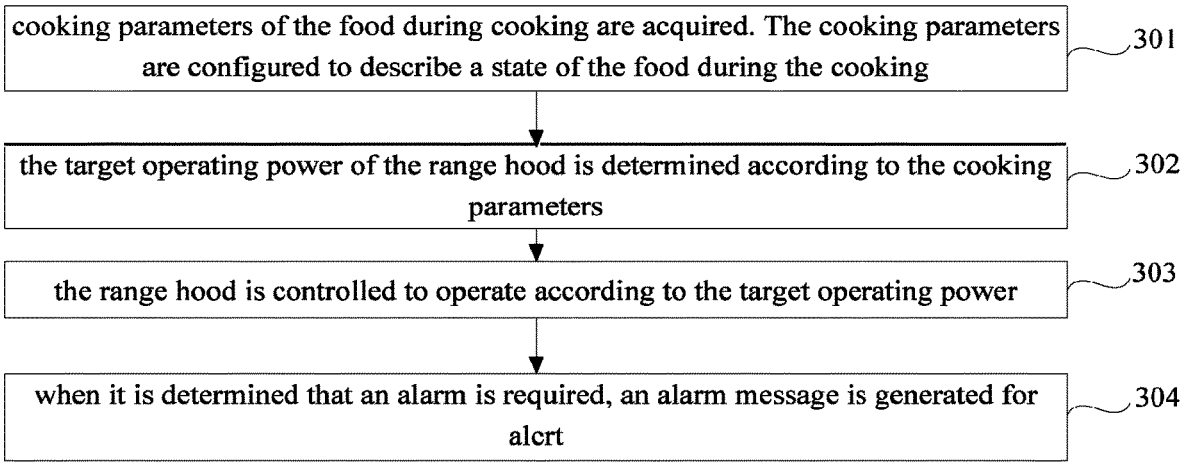
FIG. 3 is a flow chart a method for controlling a range hood according to another embodiment of the present disclosure.

FIG. 3 is a flow chart of a method for controlling a range hood according to another embodiment of the present disclosure. As illustrated in FIG. 3, the method may include the followings.

At block 301, cooking parameters of the food during cooking are acquired. The cooking parameters are configured to describe a state of the food during the cooking.

When the food is in the cooking process, the state of the food during the cooking can be used to characterize cooking smoke that the food may generate. For example, the greater the amount of the food during cooking is, the more cooking smoke may be generated during current cooking. For another example, when the food is in an overcooking state (such as a scorched state), the food may also generate more cooking smoke. Therefore, in embodiments of the present disclosure, in order to determine the operating power of the range hood for discharging the cooking smoke, it is necessary to determine the cooking parameters of the food during the cooking first.

The cooking parameters may include at least one of a weight of the food, a current color of the food and a smoke density. Certainly, the cooking parameters may also include other data for describing the cooking status of the food, such as water content in the food. The cooking parameters are not limited in embodiments of the disclosure.

Accordingly, acquiring the cooking parameters of the food during the cooking may include at least one of following steps.

(1) Weight data reported by a cooking stove or a cooking pot for cooking the food is received, and the weight of the food is determined according to the weight data.

As illustrated in FIG. 1, a weight scale may be installed on the cooking stove or the cooking pot for cooking the food. When there is food in the cooking stove or the cooking pot, the cooking stove or the cooking pot can acquire weight data at this time, and report the weight data to the control center. When the control center receives the weight data, the control center can remove a net weight of the cooking stove or the cooking pot from the weight data, to acquire the weight of the food.

In at least one embodiment, a zero point of the scale installed on the cooking stove or the cooking pot can be set in advance, such that the weight data acquired through the scale is the weight data excluding the weight of the cooking stove or the cooking pot. In this case, when the control center receives the weight data, the control center can directly determine the weight data as the weight of the food.

(2) Pictures of the food are captured by a camera, and the color of the food is determined according to pixel values of pixel points in the picture.

When the food is in the cooking process, the camera can capture the pictures of the food every preset time period, and report the pictures of the food to the control center. When the control center receives the pictures of the food, the control center can process the picture to determine the color of the food.

The pictures of the food may be processed as follows. The pixel value of each pixel point in the picture is acquired, and pixel values of all pixel points are averaged to obtain an average pixel value, and the obtained average pixel value is determined as the pixel value of the current color of the food.

Furthermore, in order to improve accuracy of determining the current color of the food, marginalization may be performed on the picture to obtain an outline of the cooking pot for cooking the food. In all the pixel points of the pictures, only pixel values of the pixel points within the outline are averaged to obtain an average pixel value, and the average pixel value is determined as the pixel value of the current color of the food.

In addition, the preset time period is set in advance, and the preset time period may be 2s, 3s or 5s. In particular, in order to make the pictures captured by the camera can represent the current state of the food, the preset time period should not be too long.

(3) The smoke density reported by the smoke density sensor is received.

Similarly, when the food is in the cooking process, the smoke density sensor disposed in the kitchen may determine the current smoke density timely or every preset time period, and report the determined smoke density to the control center.

The smoke density sensor refers to a type of sensor for detecting the smoke density in the air. The smoke density sensor may be an ionization smoke sensor, a photoelectric smoke sensor, or a gas smoke sensor.

At block 302, the target operating power of the range hood is determined according to the cooking parameters.

It can be seen from block 301 that, since the cooking parameters may include at least one of the weight of the food, the current color of the food and the smoke density. Therefore, accordingly, block 302 may include following three possible implementations.

In a first possible implementation, a scene where the cooking parameters include the weight of the food is applied. In this case, when the weight of the food is greater than a preset weight, a first preset power is set as the target operating power of the range hood. When the weight of the food is less than or equal to the preset weight, a second preset power is set as the target operating power of the range hood. The first preset power is greater than the second preset power.

The preset weight is set in advance. When the weight of the food is greater than the preset weight, it indicates that the amount of food is increased, more cooking smoke may be generated in the process of cooking the food, and thus the range hood needs to operate at a higher operating power. When the weight of the food is less than or equal to the preset weight, it indicates that the amount of food is not too much, less cooking smoke may be generated in the process of cooking the food, and thus there may be no need for the range hood to operate at the higher operating power. Therefore, when the weight of the food is greater than the preset weight, a larger first preset power may be configured for the range hood, and when the weight of the food is less than or equal to the preset weight, a smaller second preset power may be configured for the range hood.

In addition, the first preset power and the second preset power are set in advance. In practical applications, the first preset power and the second preset power may be flexibly set according to actual needs.

For example, the preset weight is 1 kg, the first preset power is 1 KW, and the second preset power is 500 W. In other words, when the weight of the food is greater than 1 kg, it is determined that the target operating power of the range hood is 1 KW, and when the weight of the food is less than or equal to 1 kg, it is determined that the target operating power of the range hood is 500 W.

In a second possible implementation, a scene where the cooking parameters include the current color of the food is applied. In this case, when the current color of the food is not within a preset color range, a third preset power is set as the target operating power of the range hood. When the current color of the food is within the preset color range, a fourth preset power is set as the target operating power of the range hood. The third preset power is greater than the fourth preset power.

The preset color range is set in advance, and the preset color range is a standard color range of the food. When the current color of the food is not within the preset color range, it indicates that the food may currently be in the overcooking state, such as a scorched state, in this case, more cooking smoke may be generated in the process of cooking the food, and thus the range hood needs to operate at a higher operating power. When the current color of the food is within the preset color range, it indicates that the food is in a standard cooking state, less cooking smoke may be generated in the process of cooking the food, and thus there may be no need for the range hood to operate at the higher operating power. Therefore, when the current color of the food is not within the preset color range, a larger third preset power may be configured for the range hood, and when the current color of the food is within the preset color range, a smaller fourth preset power may be configured for the range hood.

In addition, the third preset power and the fourth preset power are set in advance. In practical applications, the third preset power and the fourth preset power may be flexibly set according to actual needs.

For example, when the food is in the overcooking state, the color of the food may appear charred. Therefore, a pixel value range corresponding to the charred can be determined, and the preset color range can be determined according to the pixel value range corresponding to the charred, i.e., the pixel value range corresponding to the preset color range does not include the pixel value range corresponding to the charred.

In a third possible implementation, a scene where the cooking parameters include the smoke density is applied. In this case, when the smoke density is greater than a preset smoke density, a fifth preset power is set as the target operating power of the range hood. When the smoke density is less than or equal to the preset smoke density, a sixth preset power is set as the target operating power of the range hood. The fifth preset power is greater than the sixth preset power.

The preset smoke density is set in advance. When the current smoke density is greater than the preset smoke density, it indicates that there is too much cooking smoke in the kitchen, in this case, the range hood needs to operate at a higher operating power. When the current smoke density is less than or equal to the preset smoke density, it indicates that there is less cooking smoke in the kitchen, in this case, there may be no need for the range hood to operate at the higher operating power. Therefore, when the current smoke density is greater than the preset smoke density, a larger fifth preset power may be configured for the range hood, and when the current smoke density is less than or equal to the preset smoke density, a smaller sixth preset power may be configured for the range hood.

In addition, the fifth preset power and the sixth preset power are set in advance. In practical applications, the fifth preset power and the sixth preset power may be flexibly set according to actual needs.

In at least one embodiment, when the cooking parameters include other parameters configured to characterize the cooking state of the food, the target operating power of the range hood may also be determined according to the other parameters as described in the above three possible implementations.

In addition, when the cooking parameters only include one parameter of the weight of the food, the current color of the food and the smoke density, the target operating power of the range hood may be determined according to one of the above three possible implementations.

When the cooking parameters include two or more parameters, in this case, the target operating power corresponding to each parameter may be determined according to one of the foregoing three possible implementations, to obtain at least two target operating power. Then, a maximum target operating power can be selected from the at least two target operating powers, and the following block 303 is performed through the selected target operating power.

At block 303, the range hood is controlled to operate according to the target operating power.

After the control center determines the target operating power of the range hood at block 302, the control center can send a control instruction to the range hood, in which, the control instruction carries the target operating power. When the range hood receives the control instruction, the range hood can operate according to the target operating power carried by the control instruction.

At block 304, when it is determined that an alarm is required, an alarm message is generated for alert.

In at least one embodiment, in embodiments of the present disclosure, after the target operating power is determined according to block 302, when it is determined that the range hood needs to operate at the higher operating power, it indicates that there is too much cooking smoke in the kitchen. In this case, the control center may make an alarm to remind the person in the kitchen that there is too much cooking smoke in the kitchen.

In particular, in the above three possible implementations for determining the target operating power of the range hood according to the cooking parameters, there may be security problems in the kitchen in the second possible implementation and the third possible implementation. Therefore, block 304 can be divided into the following two cases.

(1) In the second possible implementation of block 303, when the third preset power is set as the target operating power of the range hood, it indicates that the current color of the food is not within the standard color range, the food may be in the scorched state. In this case, the control center can generate the alarm message to raise an alarm for the cooking.

The alarm message may be voice information. The alarm may be raised for the current cooking process by playing the voice information. For example, the alarm message may be a preset ringtone, and after the preset ringtone is played, the person in the kitchen may hear the preset ringtone and determine that there is too much cooking smoke in the kitchen.

Furthermore, in order to avoid security hazard, after the current cooking process is alarmed, power or gas for cooking the food may also be stopped supplying.

(2) In the third possible implementation of block 303, when the fifth preset power is set as the target operating power of the range hood, it indicates that there is too much cooking smoke in the kitchen, and safety of the person in the kitchen may be affected. Therefore, the control center can generate the alarm message to raise an alarm for the cooking.

Furthermore, in order to avoid security hazard, after the current cooking process is alarmed, power or gas for cooking the food may also be stopped supplying.

In embodiments of the present disclosure, the target operating power of the range hood is determined according to the cooking parameters of the food during cooking, such that the range hood can be controlled to operate according to the target operating power. Since the cooking parameters are configured to describe the state of the food during the cooking, the method for controlling a range hood provided by embodiments of the present disclosure can automatically adjust the operating power of the range hood according to the state of the food during the cooking and avoid adjusting the operating power of the range hood manually, thereby improving efficiency of controlling the range hood, and improving user experience of the range hood.

Figure 4:
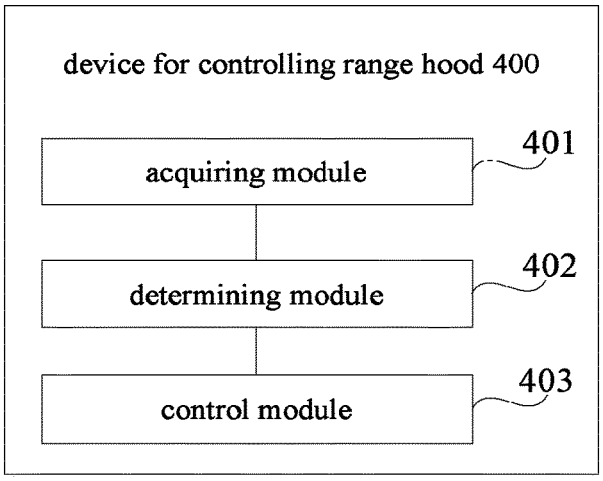
FIG. 4 is a block diagram of a device for controlling a range hood according to an embodiment of the present disclosure.

FIG. 4 is a block diagram of a device for controlling a range hood according to an embodiment of the present disclosure. As illustrated in FIG. 4, the device includes an acquiring module 401, a determining module 402 and a control module 403.

The acquiring module 401 is configured to acquire cooking parameters of food during cooking. The cooking parameters are configured to describe a state of the food during cooking.

The determining module 402 is configured to determine a target operating power of the range hood according to the cooking parameters.

The control module 403 is configured to control the range hood to operate according to the target operating power. For example, based on a decision of the determining module 402, the control module 403 may generate a control signal or a control instruction indicating a determined target operating power, or indicating an alarm is to be produced, and/or power or gas supply for cooking the food is to be stopped.

In at least one embodiment, the cooking parameters include at least one of a weight of the food, a current color of the food and a smoke density.

The acquiring module 401 is configured to perform at least one of: receiving weight data reported by a cooking stove or a cooking pot for cooking the food, and determining the weight of the food according to the weight data; acquiring a picture of the food captured by a camera, and determining the color of the food according to pixel values of pixel points in the picture; and receiving the smoke density reported by a smoke density sensor.

In at least one embodiment, the cooking parameters include the weight of the food.

The determining module 402 is configured to set a first preset power as the target operating power of the range hood when the weight of the food is greater than a preset weight, and set a second preset power as the target operating power of the range hood when the weight of the food is less than or equal to the preset weight. The first preset power is greater than the second preset power.

In at least one embodiment, the cooking parameters include the current color of the food.

The determining module 402 is configured to set a third preset power as the target operating power of the range hood when the current color of the food is not within a preset color range, in which the preset color range is a standard color range of the food, and set a fourth preset power as the target operating power of the range hood when the current color of the food is within the preset color range. The third preset power is greater than the fourth preset power.

In at least one embodiment, the determining module 402 is configured to generate an alarm message to raise an alarm for the cooking, and stop supplying power or gas for cooking the food.

In at least one embodiment, the cooking parameters include the smoke density.

The determining module 402 is configured to set a fifth preset power as the target operating power of the range hood when the smoke density is greater than a preset smoke density, and set a sixth preset power as the target operating power of the range hood when the smoke density is less than or equal to the preset smoke density. The fifth preset power is greater than the sixth preset power.

In at least one embodiment, the determining module 402 is configured to generate an alarm message to raise an alarm for the cooking, and stop supplying power or gas for cooking the food.

In embodiments of the present disclosure, the target operating power of the range hood is determined according to the cooking parameters of the food during cooking, such that the range hood can be controlled to operate according to the target operating power. Since the cooking parameters are configured to describe the state of the food during the cooking, the method for controlling a range hood provided by embodiments of the present disclosure can automatically adjust the operating power of the range hood according to the state of the food during the cooking and avoid adjusting the operating power of the range hood manually, thereby improving efficiency of controlling the range hood, and improving user experience of the range hood.

With respect to the device in the above embodiments, specific manners for performing operations for individual modules therein have been described in detail in embodiments regarding to the method, which will not be elaborated herein.

Figure 5:
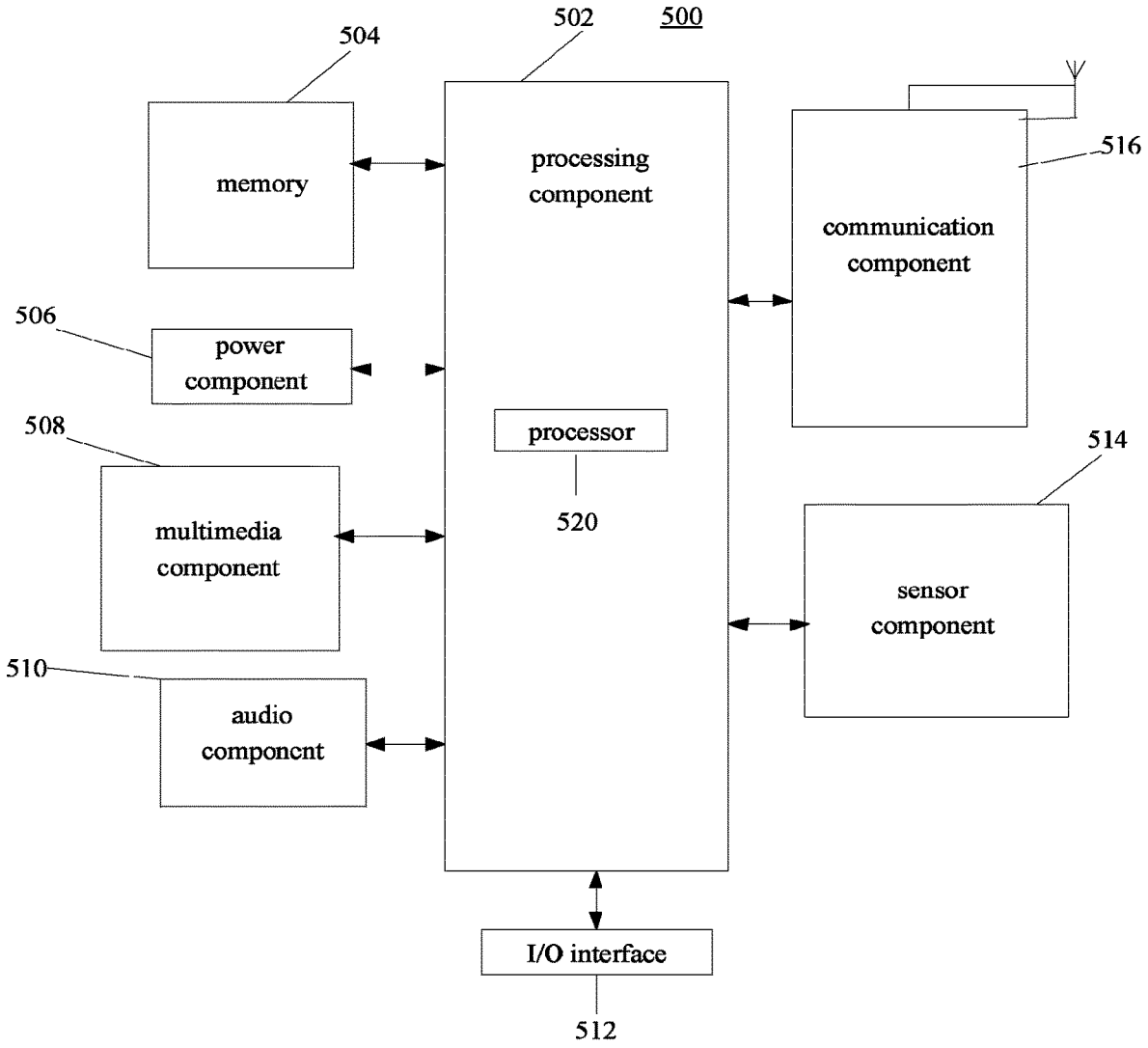
FIG. 5 is a block diagram of a device for controlling a range hood according to another embodiment of the present disclosure.

FIG. 5 is a schematic diagram illustrating a device 500 for controlling a range hood according to an embodiment of the present disclosure. For example, the device 500 may be a mobile phone, a computer, a message transceiver device, a game console, a tablet device, a medical device, a fitness device, etc. The device 500 may be integrated with the range hood, and become a part of the range hood.

Referring to FIG. 5, the device 500 may include one or more of the following components: a processing component 502, a memory 504, a power component 506, a multimedia component 508, an audio component 510, an input/output (I/O) interface 512, a sensor component 514, and a communication component 516.

The processing component 502 typically includes processing circuitry, and controls overall operations of the device 500, such as the operations associated with display, telephone calls, data communications, camera operations, and recording operations. The processing component 502 may include one or more processors 520 to execute instructions to perform all or part of the steps in the above described methods. Moreover, the processing component 502 may include one or more modules which facilitate the interaction between the processing component 502 and other components. For instance, the processing component 502 may include a multimedia module to facilitate the interaction between the multimedia component 508 and the processing component 502.

The memory 504 is configured to store various types of data to support the operation of the device 500. Examples of such data include instructions for any applications or methods operated on the device 500, contact data, phonebook data, messages, pictures, video, etc. For example, the memory 504 may include instructions for performing methods or functions described herein, such as the methods described in the FIG. 1, FIG. 2, FIG. 3, and FIG. 4 examples. The memory 504 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 506 provides power to various components of the device 500. The power component 506 may include a power management system, one or more power sources, and any other components associated with the generation, management, and distribution of power in the device 500.

The multimedia component 508 includes a screen providing an output interface between the device 500 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 508 includes a front-facing camera and/or a rear-facing camera. When the device 500 is in an operating mode, such as a shooting mode or a video mode, the front-facing camera and/or the rear-facing camera can receive external multimedia data. Each front-facing camera and rear-facing camera may be a fixed optical lens system or has focal length and optical zoom capability.

The audio component 510 is configured to output and/or input audio signals. For example, the audio component 510 includes a microphone (MIC) configured to receive an external audio signal when the device 500 is in an operation mode, such as a call mode, a recording mode, and a voice recognition mode. The received audio signal may be further stored in the memory 504 or transmitted via the communication component 516. In some embodiments, the audio component 510 further includes a speaker to output audio signals.

The I/O interface 512 provides an interface between the processing component 502 and peripheral interface modules, such as a keyboard, a click wheel, buttons, and the like. The buttons may include, but are not limited to, a home button, a volume button, a starting button, and a locking button.

The sensor component 514 includes one or more sensors to provide status assessments of various aspects of the device 500. For instance, the sensor component 514 may detect an open/closed status of the device 500, relative positioning of components, e.g., the display and the keypad, of the device 500, a change in position of the device 500 or a component of the device 500, a presence or absence of user contact with the device 500, an orientation or an acceleration/deceleration of the device 500, and a change in temperature of the device 500. The sensor component 514 may include a proximity sensor configured to detect the presence of nearby objects without any physical contact. The sensor component 514 may also include a light sensor, such as a CMOS or CCD image sensor, for use in imaging applications. In some embodiments, the sensor component 514 may also include an accelerometer sensor, a gyroscope sensor, a magnetic sensor, a pressure sensor, or a temperature sensor.

The communication component 516 is configured to facilitate communication, wired or wirelessly, between the device 500 and other devices. The device 500 can access a wireless network based on a communication standard, such as WiFi, 2G, or 3G, or a combination thereof. In one exemplary embodiment, the communication component 516 receives a broadcast signal or broadcast associated information from an external broadcast management system via a broadcast channel. In one exemplary embodiment, the communication component 516 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the device 500 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary embodiments, there is also provided a non-transitory computer-readable storage medium including instructions, such as the memory 504 including instructions. The instructions can be performed by the processor 520 in the device 500 to performing the above-described methods. For example, the non-transitory computer-readable storage medium may be a ROM, a RAM, a CD-ROM, a magnetic tape, a floppy disc, an optical data storage device, and the like.

There is provided a non-transitory computer readable storage medium. When instructions in the storage medium are performed by a processor of a terminal, the terminal can perform the method for controlling a range hood provided in the above embodiments.

Other embodiments of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the present disclosure only be limited by the appended claims.

What is claimed is:

1. A method, comprising:

acquiring a cooking parameter during cooking of food, wherein the cooking parameter indicates a state of the food during the cooking, and the cooking parameter includes a current color of the food, wherein the current color of the food is determined by averaging pixel values of all pixel points within a picture;

determining a target operating power of a range hood according to the cooking parameter; and controlling the range hood to operate according to the target operating power, wherein determining the target operating power of the range hood according to the cooking parameter comprises:

setting a third preset power as the target operating power of the range ood when the current color of the food is not within a preset color range and setting a fourth preset power as the target operating of the range hood when the current color of the food is within the preset color range.

2. The method according to claim 1, wherein the acquiring the cooking parameter during the cooking of the food comprises at least one of:

receiving weight data from a cooking stove or a cooking pot, and determining a weight of the food according to the weight data;

receiving a picture of the food from a camera, and determining a color of the food according to pixel values of the picture; or receiving a smoke density from a smoke density sensor.

3. The method according to claim 1, wherein the determining the target operating power of the range hood according to the cooking parameter comprises:

setting a first preset power as the target operating power of the range hood when a weight of the food is greater than. a preset weight; and setting a second preset power as the target operating power of the range hood when the weight of the food is less than the preset weight.

4. The method according to claim 1, further comprising:

after setting the third preset power as the target operating power of the range hood, generating an alarm message to raise an alarm for the cooking; and/or stopping supplying power or gas for cooking the food.

5. The method according to claim 1, wherein the determining the target operating power of the range hood according to the cooking parameter comprises:

setting a fifth preset power as the target operating power of the range hood when a smoke density is greater than a preset smoke density; and setting a sixth preset power as the target operating power of the range hood when the smoke density is less than the preset smoke density.

6. The method according to claim 5, further comprising:

after setting the fifth preset power as the target operating power of the range hood, generating an alarm message to raise an alarm for the cooking; and/or stopping supplying power or gas for cooking the food.

7. A device, comprising:

a processor; and a memory, configured to store instructions executable by the processor, wherein the processor is configured to:

acquire a cooking parameter during cooking of food, wherein the cooking parameter indicates a state of the food during the cooking, and the cooking parameter includes a current color of the food, wherein the current color of the food is determined by averaging pixel values of all pixel points within a picture;

determine a target operating power of the range hood according to the cooking parameter; and control the range hood to operate according to the target operating power, wherein When determining the target operating power of the range hood according to the cooking parameter, the processor is further configured to:

set a third preset power as the target operating power of the range hood when the current color of the food is not within a preset color range; and set a fourth preset power as the target operating power of the range hood when the current color of the food is within the preset color range.

8. The device according to claim 7, wherein the processor is configured to perform at least one of:

receiving weight data from a cooking stove or a cooking pot for cooking the food, and determining a weight of the food according to the weight data;

receiving a picture of the food from a camera, and determining a color of the food according to pixel values in the picture; or receiving a smoke density from a smoke density sensor.

9. The device according to claim 7, wherein the processor is configured to:

set a first preset power as the target operating power of the range hood when a weight of the food is greater than a preset weight; and set a second preset power as the target operating power of the range hood when the weight of the food is less than or equal to the preset weight.

10. The device according to claim 7, wherein the processor is further configured to:

generate an alarm message to raise an alarm for the cooking; and/or stop supplying power or gas for cooking the food.

11. The device according to claim 7, wherein the processor is configured to:

set a fifth preset power as the target operating power of the range hood when a smoke density is greater than a preset smoke density; and set a sixth preset power as the target operating power of the range hood when the smoke density is less than or equal to the preset smoke density.

12. The device according to claim 11, Wherein the processor is further configured to:

generate an alarm message to raise an alarm for the cooking; and/or stop supplying power or gas for cooking the food.

13. A computer-readable non-transitory storage medium, configured to store instructions that, when executed by a processor, cause the processor to perform a method, the method comprising:

acquiring a cooking parameter during cooking of food, wherein the cooking parameter indicates a state of the food during the cooking, and the cooking parameter includes a current color of the food, wherein the current color of the food is determined by averaging pixel values of all pixel points with a picture;

determining a target operating power of the range hood according to the cooking parameter; and controlling the range hood to operate according to the target operating power, wherein determining the target operating power of the range hood according to the cooking parameter comprises:

setting a third preset power as the target operating power of the range hood when the current color of the food is not within a preset color range; and setting a fourth preset oiwer as tge target operating power of the range hood when the current color of the food is within the preset color range.

14. The computer-readable non-transitory storage medium according to claim 13, wherein the acquiring the cooking parameter during the cooking of the food comprises at least one of:

receiving weight data from a cooking stove or a cooking pot, and determining a weight of the food according to the weight data;

receiving a picture of the food from a camera, and determining a color of the food according to pixel values of the picture; or receiving a smoke density from a smoke density sensor.

15. The computer-readable non-transitory storage medium according to claim 13, wherein the determining the target operating power of the range hood according to the cooking parameter comprises:

setting a first preset power as the target operating power of the range hood when a weight of the food is greater than a preset weight; and setting a second preset power as the target operating power of the range hood when the weight of the food is less than the preset weight.

16. The computer-readable non-transitory storage medium according to claim 13, further comprising:

after setting the third preset power as the target operating power of the range hood, generating an alarm message to raise an alarm for the cooking; and/or stopping supplying power or gas for cooking the food.

17. The computer-readable non-transitory storage medium according to claim 13, wherein the determining the target Operating power of the range hood according to the cooking parameter comprises:

setting a fifth preset power as the target operating power of the range hood when a smoke density is greater than a preset smoke density; and setting a sixth preset power as the target operating power of the range hood when the smoke density is less than the preset smoke density.

* * * * *